US006917351B1

(12) United States Patent
Velayudhan et al.

(10) Patent No.: US 6,917,351 B1
(45) Date of Patent: Jul. 12, 2005

(54) ENERGY RECOVERY IN PLASMA DISPLAY PANEL

(75) Inventors: Bala K. Velayudhan, Kuala Lumpur (MY); Jeffrey W Guy, Toledo, OH (US); Carol A Wedding, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 223 days.

(21) Appl. No.: 10/062,498

(22) Filed: Feb. 5, 2002

Related U.S. Application Data

(60) Provisional application No. 60/266,439, filed on Feb. 6, 2001.

(51) Int. Cl.[7] ..... G09G 3/28
(52) U.S. Cl. ..... 345/60; 315/169.1
(58) Field of Search ..... 345/60–62, 66–68, 345/55; 375/169.1, 169.4

(56) References Cited

U.S. PATENT DOCUMENTS 4,772,884 A 9/1988 Weber et al.
4,866,349 A 9/1989 Weber et al.
5,081,400 A 1/1992 Weber et al.
5,438,290 A 8/1995 Tanaka
5,642,018 A 6/1997 Marcotte
5,654,728 A * 8/1997 Kanazawa et al. ..... 345/68
5,670,974 A 9/1997 Ohba et al.
5,808,420 A 9/1998 Rilly et al.
5,828,353 A 10/1998 Kishi et al.
6,111,556 A * 8/2000 Moon ..... 345/60
6,400,343 B1 * 6/2002 Zorzan et al. ..... 345/60
6,538,627 B1 * 3/2003 Whang et al. ..... 345/60

* cited by examiner

*Primary Examiner*—Chanh Nguyen
*Assistant Examiner*—Uchendu O. Anyaso
(74) *Attorney, Agent, or Firm*—Donald K. Wedding; Jim Zegeer

(57) ABSTRACT

Energy recovery for an AC gas discharge PDP wherein the PDP has a multi phase sustain and energy is transferred between sections of the PDP instead of to an external capacitor.

3 Claims, 10 Drawing Sheets

S1, S2, S3, S4 are the waveform seen at the electrodes. The adjacent non-paired electrodes are in phase though the discharge is caused by 2 phase sustain waveforms

ENERGY RECOVERY IN PLASMA DISPLAY PANEL

Claim of priority under 35 USC 119(e) of Provisional Patent Application SN 60/266,439 filed Feb. 6, 2001.

INTRODUCTION

This invention relates to an AC gas discharge (plasma) display device wherein an ionizable gas is confined within an enclosure and is subjected to sufficient voltage(s) to cause the gas to discharge. This invention particularly relates to energy recovery in a surface discharge AC gas discharge plasma display panel (PDP).

1. Background

Examples of gas discharge (plasma) devices in the prior art include both monochrome (single color) AC plasma displays and multi-color (two or more colors) AC plasma displays.

Examples of monochrome AC gas discharge (plasma) displays known in the prior art include those disclosed in U.S. Letters Pat. No. 3,559,190 issued to Bitzer et al., U.S. Pat. No. 3,499,167 (Baker et al), U.S. Pat. No. 3,860,846 (Mayer) U.S. Pat. No. 3,964,050 (Mayer), U.S. Pat. No. 4,080,597 (Mayer) and U.S. Pat. No. 3,646,384 (Lay) and U.S. Pat. No. 4,126,807 (Wedding), all incorporate herein by reference.

Examples of multicolor AC plasma displays known in the prior art include those disclosed in U.S. Letters Pat. No. 4,233,623 issued to Pavliscak, U.S. Pat. No. 4,320,418 (Pavliscak), U.S. Pat. No. 4,827,186 (Knauer, et al.), U.S. Pat. No. 5,661,500 (Shinoda et al.), U.S. Pat. No. 5,674,553 (Shinoda, et al.), U.S. Pat. No. 5,107,182 (Sano et al.), U.S. Pat. No. 5,182,489 (Sano), U.S. Pat. No. 5,075,597 (Salavin et al), U.S. Pat. No. 5,742,122 (Amemiya, et al.), U.S. Pat. No. 5,640,068 (Amemiya et al.), U.S. Pat. No. 5,541,479 (Nagakubi) and U.S. Pat. No. 5,793,158 (Wedding), all incorporated herein by reference.

AC plasma displays are of two basic plasma display panel (PDP) structures—columnar (co-planar) discharge and surface discharge. An example of columnar discharge PDP is shown in Wedding 158 above. an example of surface discharge PDP is shown in Shinoda et al. 500 and 553 above. This invention is directed to energy recovery in a surface discharge PDP.

2. Related Prior Art

The energy recovery architecture and circuits are well known in the prior art. These include U.S. Pat. No. 4,772,884 (Weber et al.), U.S. Pat. No. 4,866,349 (Weber et al.), U.S. Pat. No. 5,081,400 (Weber et al.), U.S. Pat. No. 5,438,290 (Tanaka), 5,642,018 (Marcotte), and U.S. Pat. No. 5,670,974 (Ohba et al), U.S. Pat. No. 5,808,420 (Rilly et al) and U.S. Pat. No. 5,828,353 (Kishi et al.).

SUMMARY OF INVENTION

The invention relates to energy recovery in an AC gas surface discharge plasma display panel (PDP) whereby energy is transferred directly between sections of the PDP instead of to an external capacitor. The energy is transferred between corresponding sections of the PDP where an upward transition of one PDP section forces a downward transition of a corresponding PDP section and vice versa. This eliminates the need for an external storage capacitor as described and practiced in the prior art as disclosed in the related prior art above, specifically Weber et al 884,349,400, Tanaka 290, Marcotte 018, and Rilly et al 420.

In Ohba et al 974, energy is transferred from electronic circuitry on one side of the PDP through electrodes (conductors) to the opposite side of the PDP and is reversed on the next cycle. In the invention at bar, energy is transferred between electronics on the same side of the PDP.

Ohba et al 974 discloses a plasma display panel (PDP) energy recovery circuit wherein energy is transferred back and forth across the plasma panel. This circuit flows current through an inductor L across the panel between two electrodes.

The present invention uses the PDP as a capacitor for energy recovery with the energy recovery localized to one side of the panel. Energy is not transferred back and forth across the panel as in Ohba et al.

The present invention also uses a multiphase sustain such as a two phase sustain for improvement of the PDP operating voltage margin. Ohba et al does not use two phase sustain.

DESCRIPTION OF THE INVENTION

This invention relates to energy recovery in an AC plasma display device comprising an AC gas discharge plasma display panel (PDP) and electronic means to apply voltage potential at selected cell sites. As used herein the term cell also means pixel. In a monochrome (single color) plasma display, each gas discharge (plasma) site is called a cell, pixel, or pel. In a multiple color plasma display, two or more discharge sites (each exiting a different phosphor) form a cell, pixel or pel. Each of the multiple discharge sites may also be called a cell, pixel, pel, sub-cell, sub-pixel or sub-pel. As used herein, the term cell means any of the above including pixel, pel, sub-cell, sub-pixel, or sub-pel.

Cell sites are formed by the configuration of the electrodes. In DC PDP there are opposing orthogonal arrays of parallel electrodes, one array consisting of data electrodes and the opposing array consisting of scan electrodes, the crossover or intersection of a data electrode and an opposing orthogonal scan electrode forming a cell site. These electrodes are in direct contact with an ionizable gas. When a voltage potential is applied to a single pair of data and scan electrodes, the ionizable gas is excited and produces a gas discharge. The gas discharge may emit light in the visible region and/or emit UV light that excites a phosphor so as to cause the phosphor to emit light. Examples of DC PDP are disclosed in U.S. Pat. No. 3,886,390 (Maloney et al.), U.S. Pat. No. 3,886,404 (Kurahashi et al.), U.S. Pat. No. 4,035,689 (Ogle et al.) and U.S. Pat. No. 4,532,505 (Holz et al.), all incorporated herein by reference.

An AC PDP differs from a DC PDP in that at least one electrode at the cell site in an AC PDP is covered by a dielectric material and is not in direct contact with the ionizable gas. A special case of AC PDP is a surface discharge PDP structure, for example, as disclosed by Shinoda 500 and 553 above, for a color AC gas discharge (plasma) display. In the referenced Shinoda patents, two parallel electrodes on a front substrate act to produce a sustain voltage and an orthogonal data electrode on the rear substrate provides the write and erase voltage pulses.

Figure 1:
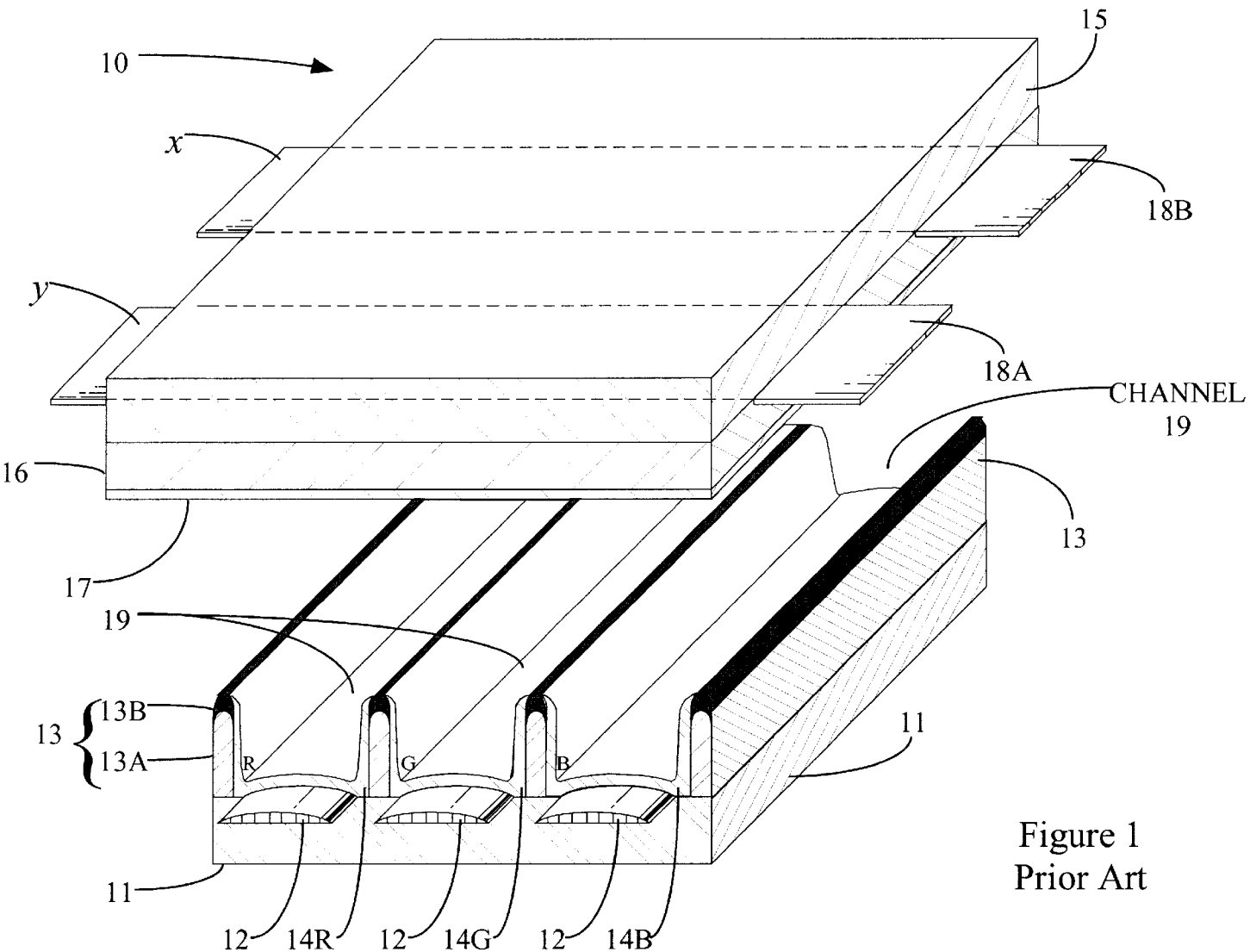
Figure 1 Prior Art
FIG. 1 shows a prospective view of an AC gas discharge (plasma) display with a surface discharge PDP structure.
Figure 2:
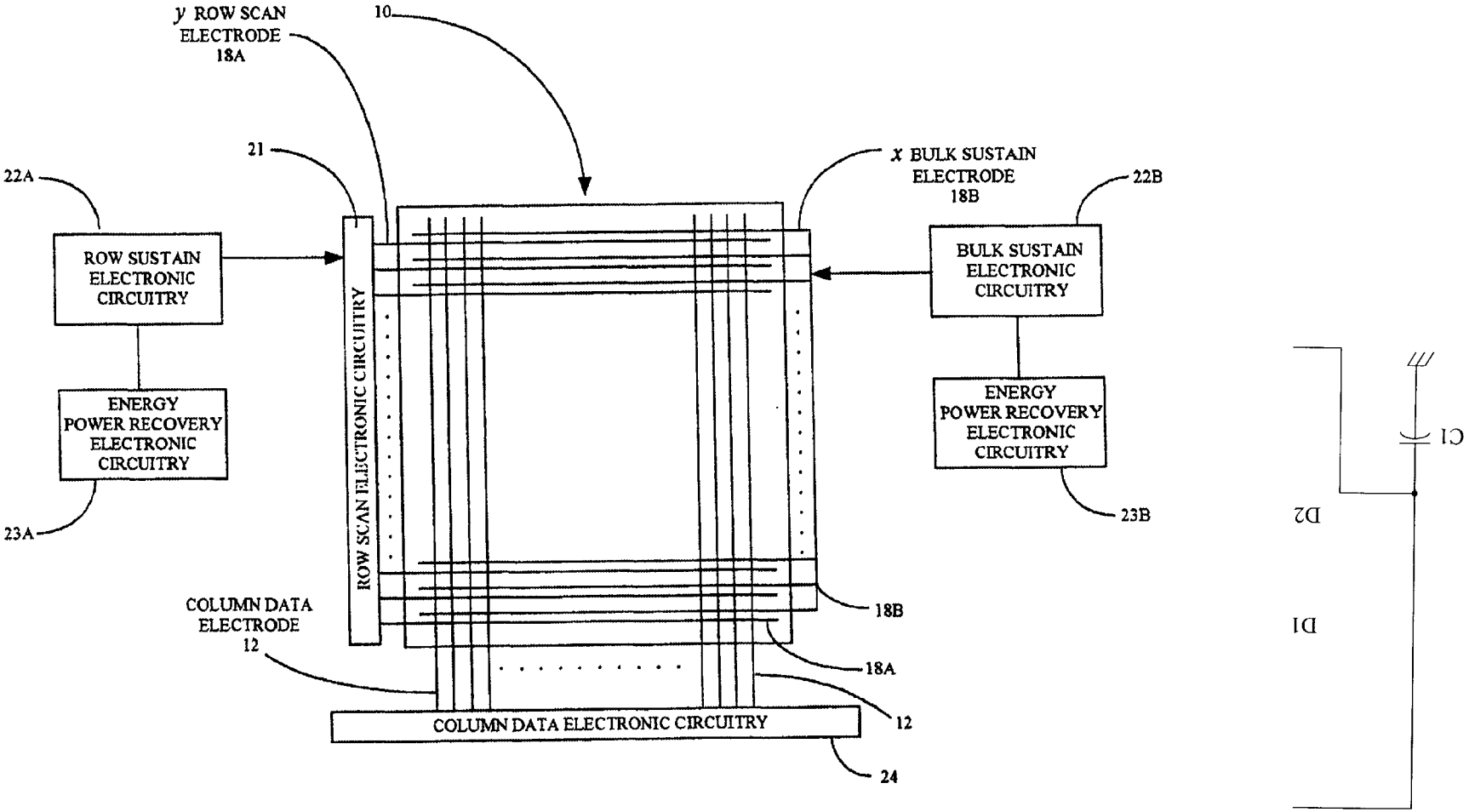
FIG. 2 shows a block diagram for driving an AC gas discharge plasma display with a surface discharge PDP structure.

FIG. 1 shows an AC gas discharge plasma display panel with a surface discharge structure 10 similar to the surface discharge structure illustrated and described in FIG. 2 of U.S. Pat. No. 5,661,500 (Shinoda et al.) which is cited above and incorporated herein by reference. The panel structure 10 has a bottom or rear glass substrate 11 with column data electrodes 12, barriers 13, and phosphor 14R, 14G, 14B.

Each barrier 13 comprises a bottom portion 13A and a top portion 13B. The top portion 13B is dark or black for increased contrast ratio. The bottom portion 13A may be translucent, opaque, dark, or black.

The top substrate 15 is transparent glass for viewing and contains y row scan electrode 18A and x bulk sustain electrode 18B, dielectric layer 16 covering the electrodes 18A and 18B, and a magnesium oxide layer 17 covering the surface of dielectric 16. The magnesium oxide is for secondary electron emission and helps lower the overall operating voltage of the display.

A plurality of channels 19 are formed by the barriers 13 containing the phosphor 14. When the two substrates 11 and 15 are sealed together, an ionizable gas mixture is introduced into the channels 19. This is typically a Penning mixture of the rare gases. Such gases are well known in the manufacture and operation of gas discharge displays.

As noted above, each electrode 12 on the bottom substrate 11 is called a column data electrode. The y electrode 18A on the top substrate 15 is the row scan electrode and the x electrode 18B on the top substrate 15 is the bulk sustain electrode. The gas discharge is initiated by voltages applied between a bottom column data electrode 12 and a top y row scan electrode 18A. The sustaining of the resulting discharge is done between an electrode pair of the top y row scan electrode 18A and a top x bulk sustain electrode 18B. Each pair of the y and x electrodes is a row.

Phosphor 14R emits red luminance when excited by photons from the gas discharge within the plasma panel. Phosphor 14G emits green luminance when excited by photons from the gas discharge within the plasma panel. Phosphor 14B emits blue luminance when excited by photons for the gas discharge within the plasma panel.

Although not illustrated in FIG. 1, the y row scan electrode 18A and the x bulk sustain electrode 18B may each be a transparent material such as tin oxide or indium tin oxide (ITO) with a conductive thin strip, ribbon or bus bar along one edge. The thin strip may be any conductive material including gold, silver, chrome-copper chrome, or like material. Both pure metals and alloys may be used. This conductive strip is illustrated in FIG. 2 of Shinoda 500.

In the prior art, some surface discharge PDP structures have been described with four or more electrodes including three or more electrodes on the front substrate. The practice of this invention is intended to cover surface discharge PDP structures having two or more electrodes on the front substrate and one or more on the rear substrate.

The practice of this invention is also intended to cover surface discharge structures where there is the sharing of electrodes on the front substrate. Fujitsu calls this structure "alternating Lighting on Surfaces" or ALIS. It is described in a paper by Kanazawa et al published on pages 154 to 157 of the 1999 *Digest of the Society for Information Display.*

The drive system for an AC plasma display includes electronic circuitry for applying write voltage pulses, erase voltage pulses, and sustain voltage pulses in a selectable fashion to one or more cells. A write pulse at a cell cite causes the gas to discharge and emit light. An erase pulse neutralizes and/or extinguishes dielectric wall charges. A sustain pulse causes a cell previously written to continue to emit light until subjected to an erase pulse.

One basic electronic architecture for applying voltages to the three electrodes 12, 18A, 18B is disclosed in U.S. letters Pat. No. 5,446,344 issued to Yoshikazu Kanazawa of Fujitsu. This basic architecture is widely used in the industry for addressing and sustaining AC gas discharge (plasma) displays and has been labeled by Fujitsu as ADS (Address Display Separately). In addition to ADS, other suitable architectures are known in the art and are available for addressing and sustaining the electrodes 12, 18A, and 18B of FIG. 1.

FIG. 2 shows display panel 10 with electronic circuitry 21 for the y row scan electrodes 18A, bulk sustain electronic circuitry 22B for x bulk sustain electrode 18B and column data electronic circuitry 24 for the column data electrodes 12.

There is also shown row sustain electronic circuitry 22A with an energy power recovery electronic circuit 23A. There is also shown energy power recovery electronic circuitry 23B for the bulk sustain electronic circuitry 22B. Examples of energy recovery architecture and circuits are disclosed in the related prior art listed above.

In the operation of an AC plasma display panel, the ionization current used to create heat and light is lost and is not recoverable. The loses for the ionization current are directly proportional to the size of the PDP cell or pixel. However, it is possible to have energy recovery of the displacement current. This invention is directed to energy recovery of the displacement current.

This invention relates to an energy recovery in an AC gas discharge plasma display panel (PDP) in which energy is transferred between alternate row pairs of electrodes, More particularly, this invention relates to a unique system or method for recapturing displacement current energy in an AC surface discharge PDP that otherwise would be lost in the resistance of the circuit. Other methods to recover energy exist in the prior art, but this invention is unique because:

- It uses the PDP capacitance as a storage capacitor
- It allows for a multi phase sustain, such as two phases, with a minimum of circuitry
- External storage capacitors are not needed
- There is no energy transfer back and forth across the panel.

In the prior art as listed above, the energy recovery is based on a single phase and the energy recovery process recovers displacement current on both transitions of the sustain pulse. In addition, the prior art uses external storage capacitors not needed in the practice of this invention or transfers energy back and forth across the panel.

Figure 3:
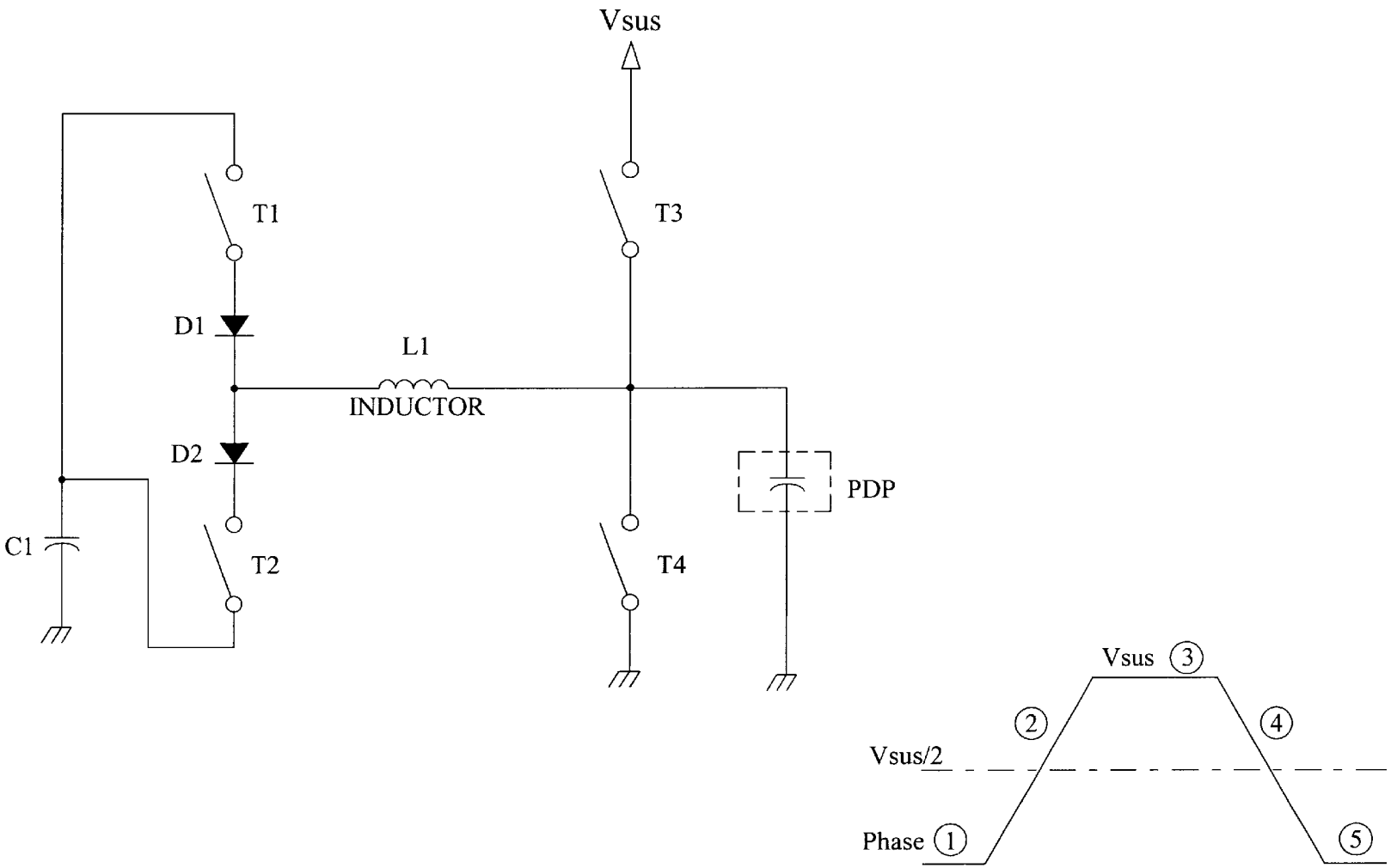
Figure 3 Prior Art
FIG. 3 shows a typical prior art energy recovery system for a PDP.

FIG. 3 illustrates a typical prior art PDP energy recovery with diodes D1 and D2 and sustain voltage waveform phases 1, 2, 3, 4, 5. Such a PDP energy recovery is disclosed in the Weber et al. patents listed above.

Phase 1 of FIG. 3 shows the beginning of the sustain transition of either the bulk sustain electrode x or row scan electrode y with respect to ground. Phase 1 is the beginning of the sustain transition. At this time T1 is closed and current flows into the AC plasma display panel (PDP) and builds an electromotive field (EMF) in L1. L1 is selected such that L1 in combination with the Capacitance of the PDP forms a desired slope for the sustain waveform.

Phase 2 begins when the slope reaches Vsus/2. Vsus is the sustain voltage for the PDP. At this time the sustain transition of the PDP reaches the same potential as the storage capacitor C1 (Vsus/2). The electromotive field EMF collapses and forces the current in the same direction through the inductor L1, forcing the sustain waveform to approach Vsus. In an ideal situation, the energy stored in the inductor L1 during phase 1 will suffice the sustain waveform transition to reach Vsus. In practice the sustain waveform, due to electrical losses in sustain circuitry, will not reach the full amplitude of the sustain voltage Vsus. The sustain waveform is clamped to Vsus amplitude. Ionization occurs at the end of phase 2, with phase 3 beginning when T3 is closed.

Phase 3 commences when T3 is closed to clamp the sustain voltage at Vsus and to provide the needed ionization current. Because the L1, D1, D2 circuit is not perfect, the voltage will not quite get to Vsus. Ionization current is lost as light and heat during the gas discharge. T3 is closed for a period of time sufficient to create wall charge on the row scan electrodes y and bulk sustain electrode x.

Phase 4 is the down transition. T3 and T1 are opened and T2 is closed. This is the reverse of phase 1. Current flows out of the PDP through the inductor L1 (causing a build up of the electromotive field EMF in L1 in the opposite direction of Phase 1) and into the storage capacitor C1.

Phase 5 begins when the sustain voltage to the PDP decreases to Vsus/2. At this time the EMF of L1 collapses and the current is forced in the same direction through the inductor L1 forcing the sustain waveform to approach ground. Because of electrical losses, the sustain waveform will not reach ground potential. In practice the sustain waveform will be clamped to ground potential.

Figure 4:
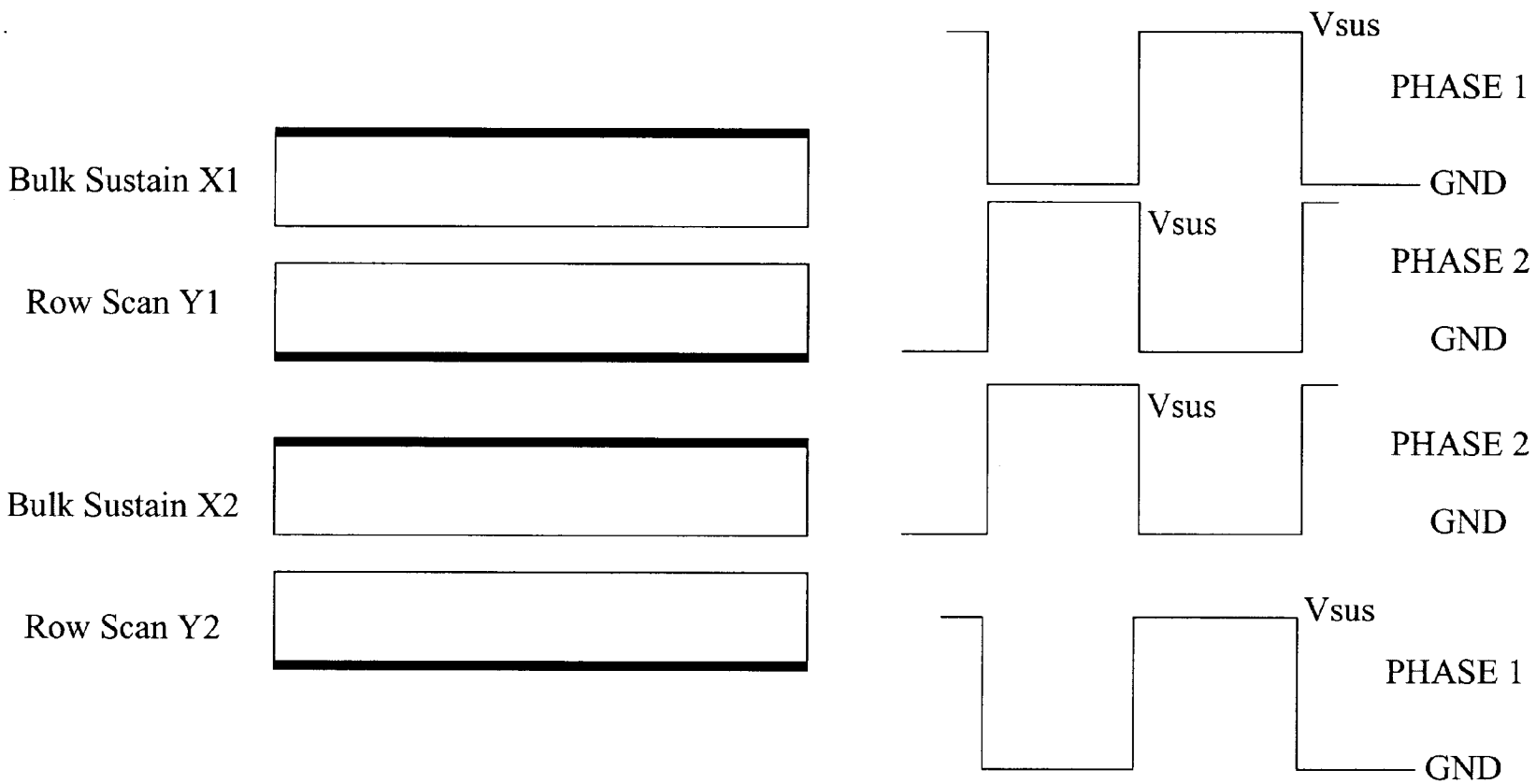
Figure 4 Prior Art
FIG. 4 shows a prior art dual phase sustain system for a PDP.

Phase 6 begins when T4 closes and clamps the electrode to ground and sets up the cell for the next discharge cycle FIG. 4 shows a prior art dual phase sustain system. In a two phase system, electrode pairs are sustained 180 degrees out of phase. This is shown in FIG. 4. This arrangement precludes interaction from adjacent non paired row scan electrodes y and bulk sustain electrodes x.

Figure 5:
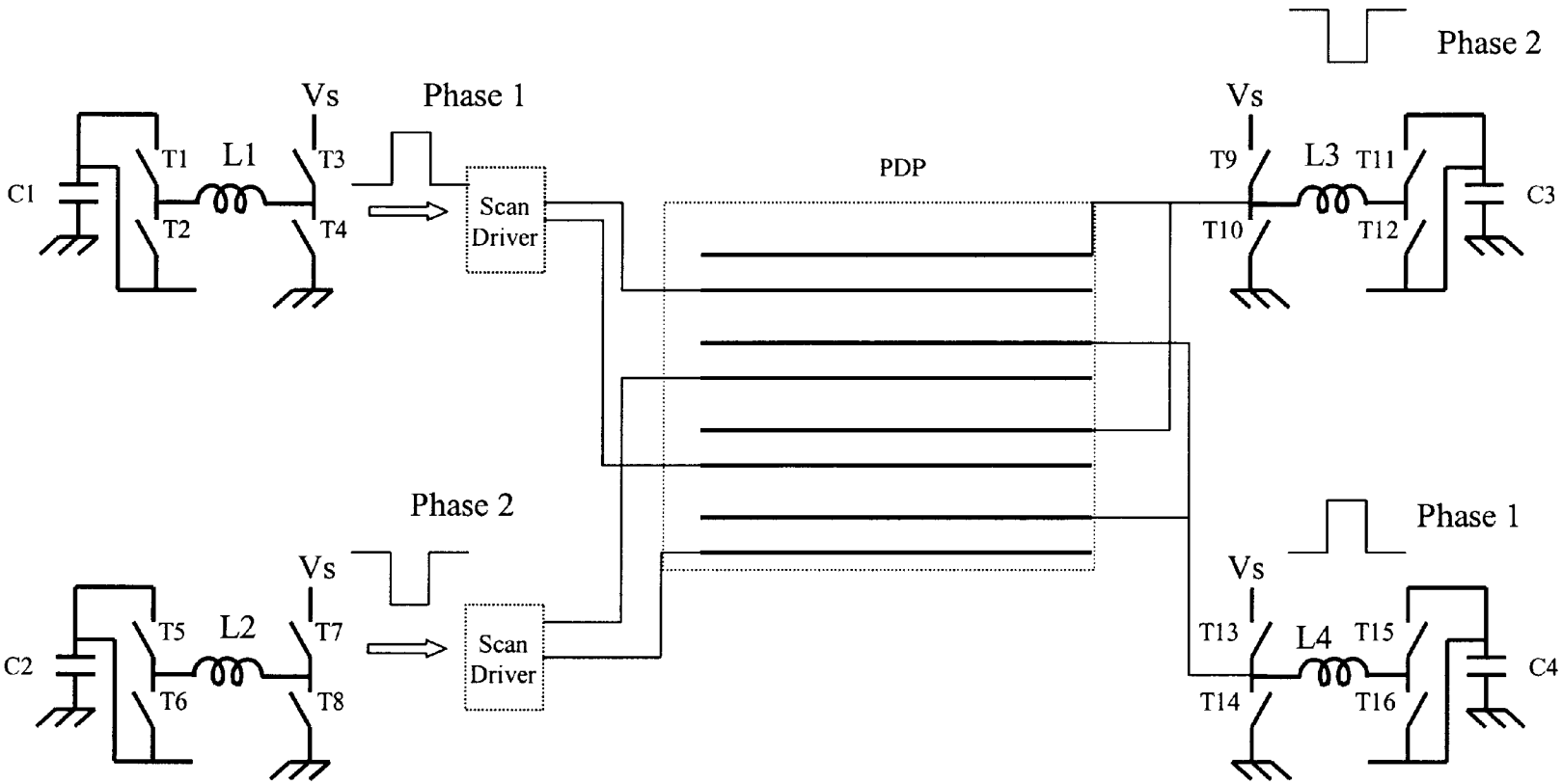
Figure 5 Prior Art
FIG. 5 shows a prior art energy recovery system for a dual phase sustain system for a PDP.

FIG. 5 shows a prior art energy recovery for a dual phase sustain system and shows the standard energy recovery employed with this system. C1 through C4 are the external storage capacitors, and L1 through L4 are the energy recovery inductors.

This invention involves PDP energy recovery and dual phase sustain circuit that allows for a minimum of electronic components so as to achieve both energy recovery and a dual phase sustain. This produces topology with minimum lead length between the PDP and the energy recovery circuit.

In accordance with this invention, energy is transferred directly between sections of the PDP instead of to an external capacitor or back and forth across the panel. The energy is transferred between corresponding sections of the panel, where an upward transition of one section forces a downward transition of a corresponding section of the PDP and vice versa.

Figure 6:
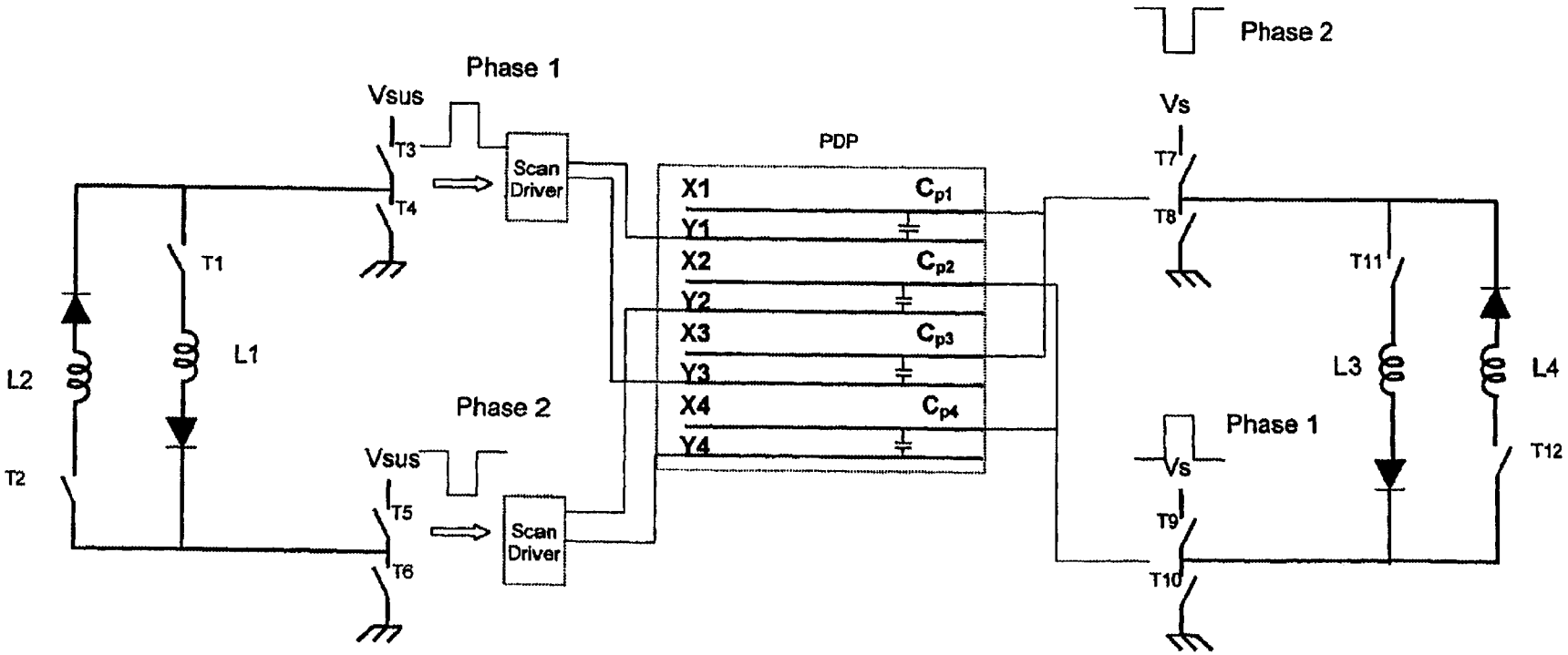
FIG. 6 shows a circuit and one embodiment for the practice of this invention using a dual phase and energy recovery system for a PDP.

FIG. 6 illustrates one embodiment of this invention comprising a novel system and method for dual phase and energy recovery in an AC surface discharge PDP. In the illustration of this embodiment, the vertical resolution of the PDP in FIG. 6 is limited to 4 lines, that is four pairs of x and y electrodes. However, more pairs may be used.

In the FIG. 6, Vsus is the sustaining voltage, L1 to L4 are inductors, T1 to T12 are switching components, X1 to X4 are bulk sustain electrodes (x in FIG. 1), Y1 to Y4 are row scan (or sustain) electrodes (y in FIG. 1), and $C_{P1}$ to $CP_4$ are each a capacitance between a bulk sustain and row scan electrode. Each inductor L is shown with a diode.

Row scan electrodes Y1 and Y3 are connected to Phase 1 of the row scan sustain circuitry and scan circuitry and row scan electrodes Y2 and Y4 are connected to Phase 2 of the row scan and sustain scan circuitry. Bulk sustain electrodes X1 and X3 are connected to Phase 2 of bulk sustain circuitry and bulk sustain electrodes X2 and X4 are connected to Phase 1 of bulk sustain circuitry.

The row scan circuitry is the combination of the sustain circuitry and its corresponding scan driver. The row scan electrodes Y are also called row sustain electrodes because the Y electrodes have the dual function of both addressing and sustaining.

Cp is the row capacitance defined by both the row sustain electrode and bulk sustain electrode. Row capacitance is defined by summation of individual cell capacitance of the said row. Cell capacitance is directly proportional to the distance between the row sustain electrode and the bulk sustain electrode and the thickness of the dielectric over the said electrodes.

In FIG. 6, capacitance $C_{p1}$ is defined by X1 and Y1, $C_{p2}$ is defined by X2 and Y2, $C_{p3}$ is defined by X3 and Y3, and $C_{p4}$ is defined X4 and Y4.

In FIG. 6, two consecutive electrodes (conductors) from either side of the PDP are driven out of phase from each other.

In accordance with this invention, the sustain transition of both Yn row scan and Xn bulk sustain electrodes of a given pair will move in the opposite transitions simultaneously when performing this method of energy recovery, where n denotes the nth line of the PDP.

As described previously, when Y1 performs an upward transition, correspondingly X1 is forced in a downward transition. Hence the energy recovery of both the row sustain (or scan) electrode Y1 and the bulk sustain electrode X1 are simultaneous but in opposite directions.

Figure 7:
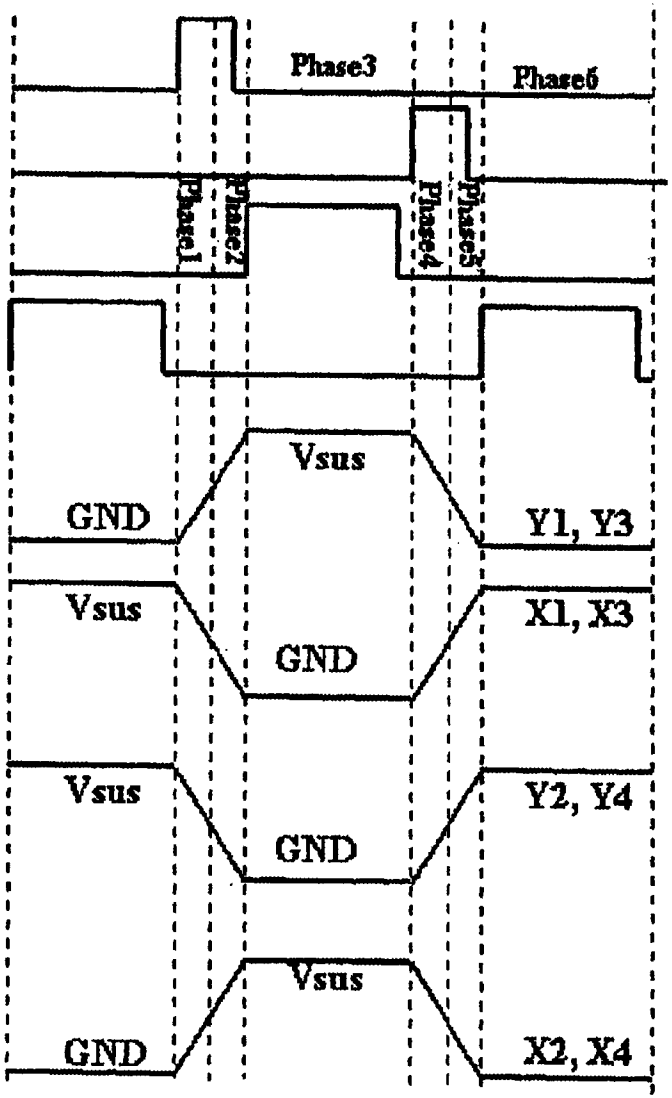
FIG. 7 shows a timing sequence for the electronic circuit of FIG. 6.
Figure 8:
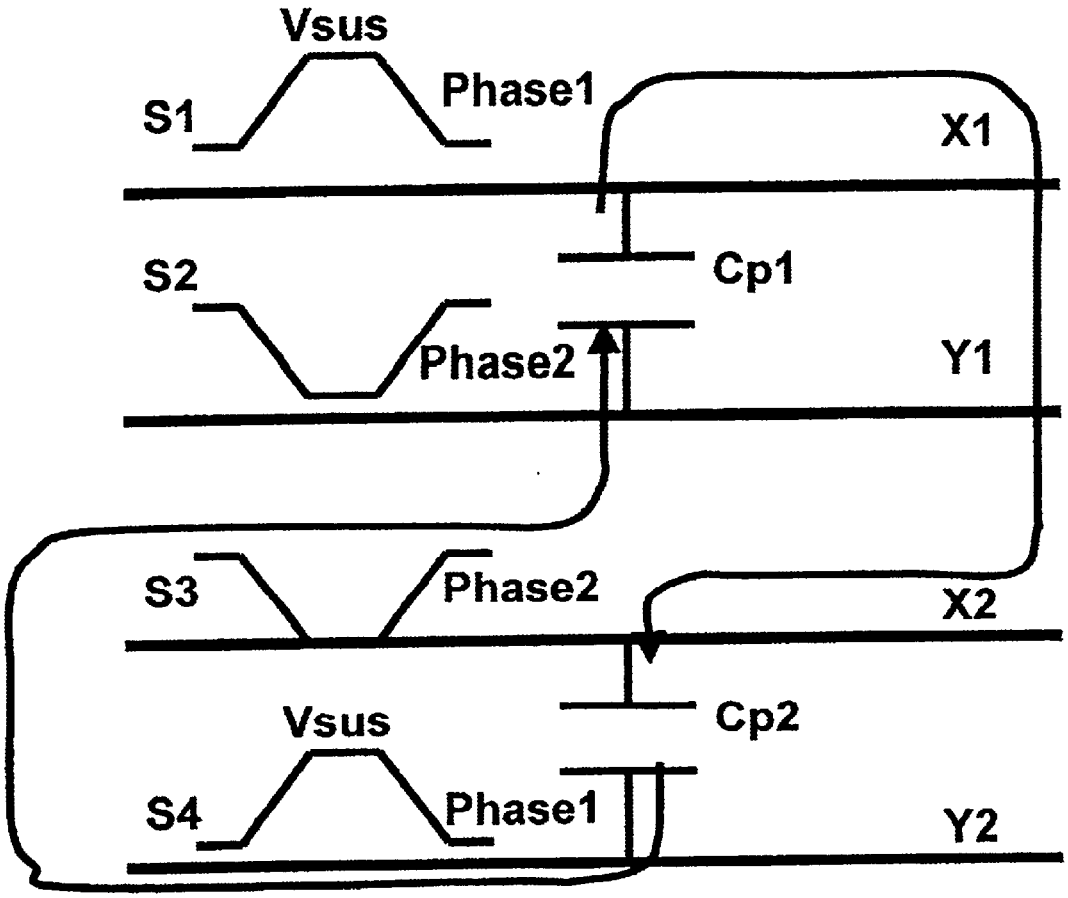
FIG. 8 shows the path of the current for the transfer of energy between capacitors $C_{P1}$ and $C_{P2}$ in FIG. 6.

FIG. 7 illustrates the various switching sequence of the circuit depicted in FIG. 6 for Phases 1 through 6. FIG. 8 illustrates the waveforms at the electrodes X1, Y1, X2, Y2.

Phase 1

Cycle is started with both row electrodes Y2, Y4 and bulk sustain electrodes X1, X3 being at Vsus potential and row electrodes Y1, Y3 and bulk sustain electrodes X2, X4 at ground.

Phase 1 is comprised of an upward sustain transition of row electrodes Y1, Y3 and bulk sustain electrodes X2, X4 and downward sustain transition of row electrodes Y2, Y4 and bulk sustain electrodes X1, X3. Energy is recycled between Y1:X1, Y3:X3 pairs and Y2:X2, Y4:X4 pairs, as shown in FIG. 7 and FIG. 8.

When T2 closes, current flows from Y2, Y4 through L2 to Y1, Y3 and simultaneously on the bulk sustain side T11 is closed forcing current to flow from X1, X3 to bulk electrodes X2, X4. This switching configuration reverses the polarity across the capacitors $C_{p1}$ $C_{p2}$, $C_{p3}$ and $C_{p4}$. The current flow through inductors L2 and L3 results an EMF build up.

Phase 2

Phase 2 starts when $C_{p1}$, $C_{p3}$ and $C_{p2}$, $C_{p4}$ are at the same potential (Vsus/2), causing the collapse of EMF in L2 and L3 and forcing the potential at row electrode Y1, Y3 and bulk sustain electrode X2, X4 to Vsus and simultaneously forcing Y2, Y4 and X1 ,X3 to ground.

Phase 3

In Phase 3, T3 and T6 of the row scan sustain circuitry are closed and T9 and T8 of the bulk sustain circuitry are closed to provide the needed ionization energy. T3, T6, T9 and T8 are closed for a duration that will allow for maximum wall charge formation on the dielectric walls of the PDP. Typically this is about 2 microseconds.

Phase 4

In phase 4, T1 of the row scan electorde sustain circuitry is closed and T12 of the bulk sustain electrode circuitry is closed. All other switches are opened. On the scan side, current flows from Y1 and Y3 through L1 to Y2 and Y4. Correspondingly on the bulk sustain side current flows into X1 and X3 through L4 from X2 and X4. The current flow through the inductors L1 and L4 results in EMF build up in the respective inductors.

Phase 5

Phase 5 starts when $C_{p1}$, $C_{p3}$ and $C_{p2}$, $C_{p4}$ are at the same potential (Vsus/2). The resulting EMF from the collapse of electric field in both L1 and L4 forces the potential at row electrode Y2, Y4 and bulk electrode X1, X3 to Vsus and simultaneously forcing Y1, Y3 and X2,X4 to ground.

Phase 6

In phase 6, T5 and T4 of the row scan sustain circuitry and T7 and T10 of the bulk sustain circuitry are closed to provide the needed ionization current. T5, T4, T7 and T10 are closed for a time duration that will allow for maximum wall charge formation on the dielectric walls of the PDP Typically this is about 2 microseconds.

Figure 6A:
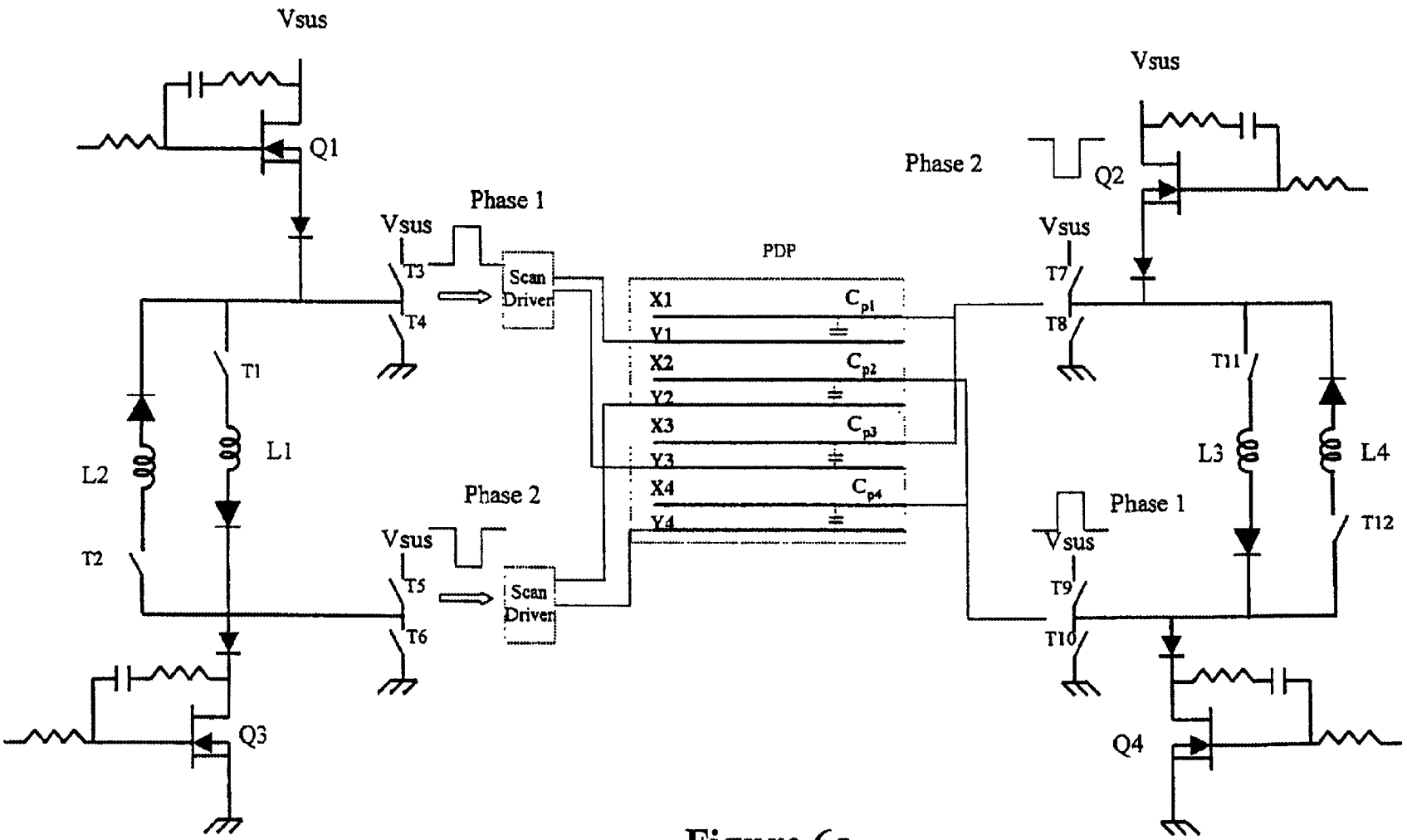
FIGS. 6*a* and 6*b* show alternative embodiments for the practice of this invention.

FIG. 6*a* shows four additional transistor Q1, Q2, Q3, Q4 connected to the energy recovery circuit of FIG. 6. These transistors are used to provide a controlled slope on the rise of the first sustain pulse after write. This is important because one out of the two electrodes is required to switch to the opposite voltage without the other electrode changing at the beginning of every cycle. Without the transistor, there is an uncontrolled transition every time one sustain voltage pulse changes state without the other sustain voltage phase also changing state. Without the transistor the rise to Vsus will cause ringing and may cause potential damage to the electronics.

Figure 6B:
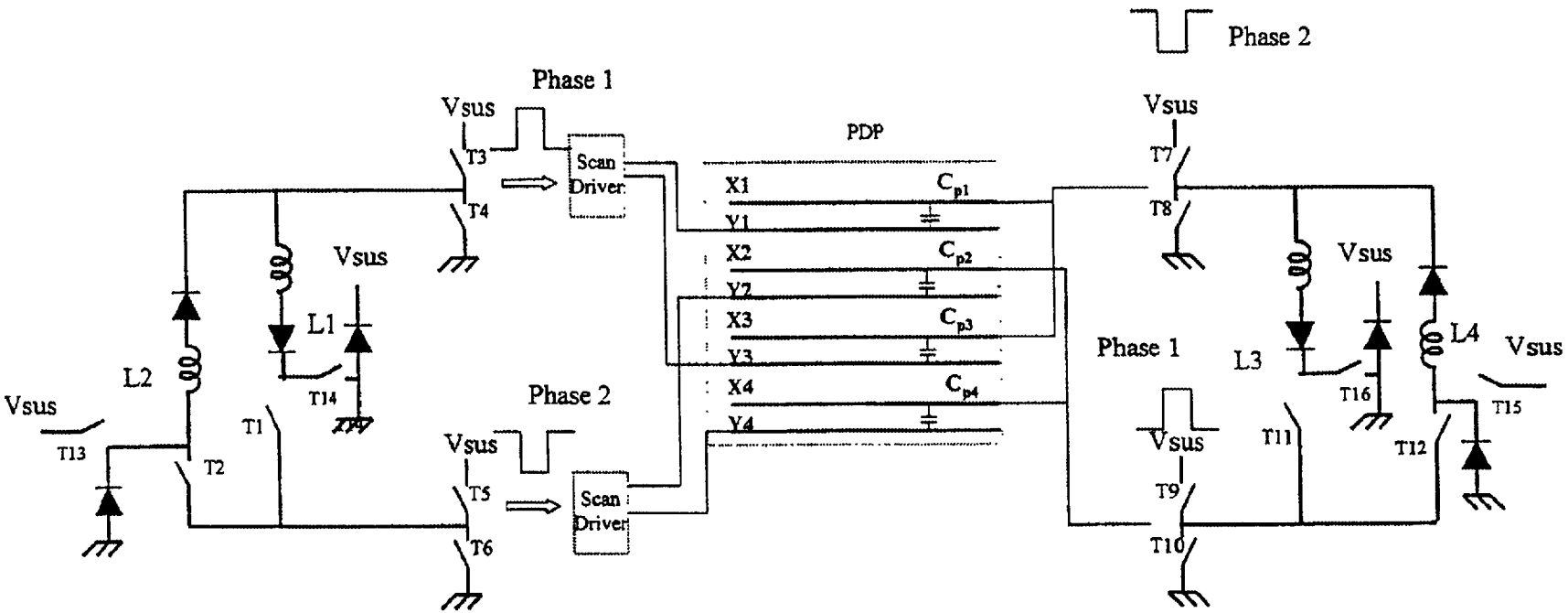

FIG. 6*b* is an alternative circuit to FIGS. 6 and 6*a* with the addition of four switches T13, T14, T15, T16. These switches are normally open. However they close on the first sustain transition after addressing. This forces Vsus through the inductors L1, L2, L3, L4. This provides a controlled slope and also has the advantage of providing energy recover on the first transition.

FIG. 7 is the switching sequence for the energy recovery circuit shown in FIG. 6. The switching combinations of switches T2 through T11 will yield waveforms at the Row Sustain electrode (Y1, Y2, Y3, and Y4) and Bulk Sustain Electrode (X1, X2, X3 and X4) as shown in FIG. 7.

Row Scan Sustain Electrodes Y1 and Y3 will ramp positively to Vsus and correspondingly Bulk Sustain Electrodes X1 and X3 will ramp to ground in this particular example. Bulk Sustain Electrode X1 and Row Scan Sustain Electrode Y2 are in phase while Bulk Sustain X3 and Row Scan Sustain Electrode Y4 are in phase.

In FIG. 8 $C_{p1}$ and $C_{p2}$ are the line capacitance between electrodes X1:Y1 and X2:Y2 respectively. S1 through S4 are the sustain voltage waveform seen at the respective electrodes, where S1 and S4 are Phase 1 of the sustain voltage waveform while S2 and S3 are Phase 2 of the sustain waveform.

FIG. 8 shows the displacement current path in transferring energy between $C_{p1}$ and $C_{p2}$. The polarity across electrodes X1:Y2 is reversed at every sustain cycle, to produce the AC sustain voltage waveform.

What is claimed is:

1. In an energy recovery system for recapturing energy stored in the capacitance of an AC gas discharge plasma display panel having a multiplicity of pixels and rows, each pixel being defined by a row scan electrode Y, a bulk sustain electrode X, and a column data electrode, each row being defined by a pair of adjacent parallel electrodes consisting of a row scan electrode Y and a bulk sustain electrode X, a first row consisting of a row scan electrode Y1 and a bulk sustain electrode X1, the sustain voltage to Y1 having a polarity 1 and the sustain voltage to X1 having an opposite polarity 2, a second row consisting of a row scan electrode Y2 and a bulk sustain electrode X2, the sustain voltage to Y2 ha a polarity 2 and the sustain voltage to X2 having an opposite polarity 1, a first energy recovery circuit connected between Y1 and Y2 and a second energy recovery circuitry connected between X1 and X2, the improvement wherein said first and second energy recovery circuits are simultaneously operated such that the energy stored in the capacitance of the first row consisting of row scan electrode Y1 and bulk sustain electrode X1 is directly transferred to the second row consisting of row scan electrode Y2 and bulk sustain electrode X2 and the energy stored in the capacitance of the second row consisting of row scan electrode Y2 and bulk sustain electrode X2 is directly transferred to the first row consisting of row scan electrode Y1 and bulk sustain electrode X1, both energy transfers being simultaneous without using an external storage capacitor.

2. In an energy recovery circuit for recapturing energy stored in the capacitance of an AC gas discharge plasma display panel having a multiplicity of pixels and rows, each pixel being defined by a row scan electrode Y, a bulk sustain electrode X, and a column data electrode, each row being defined by a pair of adjacent parallel electrodes consisting of a row scan electrode Y and a bulk sustain electrode X, a first row consisting of a row scan electrode Y1 and a bulk sustain electrode X1, the sustain voltage to Y1 having a polarity and the sustain voltage to X1 having an opposite polarity, a second row consisting of a row scan electrode Y2 and a bulk sustain electrode X2, the sustain voltage to Y2 having a polarity equal to X1 and the sustain voltage to X2 having a polarity equal to Y1 and opposite to Y2 and X1, a first energy recovery circuit is connected between Y1 and Y2 and a second energy recovery circuitry is connected between X1 and X2, the improvement wherein said first and second energy recovery circuits are simultaneously operated such that the energy stored in the capacitance of the first row consisting of row scan electrode Y1 and bulk sustain electrode X1 is directly transferred to the second row consisting of row scan electrode Y2 and bulk sustain electrode X2 and the energy stored in the capacitance of the second row consisting of row scan electrode Y2 and bulk sustain electrode X2 is directly transferred to the first row consisting of row scan electrode Y1 and bulk sustain electrode X1, both energy transfers being simultaneous without using external energy storage capacitor.

3. In an energy recovery method for recapturing energy stored in the capacitance of an AC gas discharge plasma display panel having a multiplicity of pixels and rows, each pixel being defined by a row scan electrode Y, a bulk sustain electrode X, and a column data electrode, each row being defined by a pair of adjacent parallel electrodes consisting of a row scan electrode Y and a bulk sustain electrode X, a first row consisting of a row scan electrode Y1 and a bulk sustain electrode X1, the sustain voltage to Y1 having, a polarity and the sustain voltage to X1 having an opposite polarity, a second row consisting of a row scan electrode Y2 and a bulk sustain electrode X2, the sustain voltage to Y2 having a polarity equal to X1 and the sustain voltage to X2 having a polarity equal to Y1 and opposite to Y2 and X1, a first energy recovery circuit connected between Y1 and Y2 and a second energy recovery circuitry connected between X1 and X2, the improvement wherein said first and second energy recovery circuits are simultaneously operated such that the energy stored in the capacitance of the first row consisting of row scan electrode Y1 and bulk sustain electrode X1 is directly transferred to the second row consisting of row scan electrode Y2 and bulk sustain electrode X2 and the energy stored in the capacitance of the second row consisting of row scan electrode Y2 and bulk sustain electrode X2 is directly transferred to the first row consisting of row scan electrode Y1 and bulk sustain electrode X1, both energy transfers being simultaneous without using an external energy storage.

* * * * *